United States Patent [19]

Jasper, Jr.

[11] Patent Number: 4,813,332

[45] Date of Patent: Mar. 21, 1989

[54] ELECTROMAGNETIC LAUNCHER WITH CRYOGENIC COOLED SUPERCONDUCTING RAILS

[75] Inventor: Louis J. Jasper, Jr., Ocean, N.J.

[73] Assignee: The United States of America as represented by the Secretary of the Army, Washington, D.C.

[21] Appl. No.: 68,389

[22] Filed: Jun. 12, 1987

[51] Int. Cl.[4] ..... F41F 1/02

[52] U.S. Cl. ..... 89/8; 505/885

[58] Field of Search ..... 89/8; 124/3; 310/12; 318/135; 505/884, 885, 886, 887, 926

[56] References Cited

U.S. PATENT DOCUMENTS

| | | | |
|---|---|---|---|
| 1,570,699 | 1/1926 | Moorman | 89/8 |
| 3,148,587 | 9/1964 | Melhart | 89/8 |
| 3,589,300 | 6/1971 | Wipf | 89/8 |
| 4,527,457 | 7/1985 | Fikse | 89/8 |

OTHER PUBLICATIONS

R. S. Hawke, Devices for Launching Oil-g Projectiles to 150 km/s or More to Initiate Fusion, Part 2, Railgun Accelerators, UCRL-52778 Part 2, Jul. 6, 1979, pp. 9 and 24-25.

R. Kreutz, Basis and Concepts for the Electromagnetic Acceleration of Pellets for Injection into Inertial Confinement Fusion Reactor Chambers, kfk 3465, Feb. 1963, pp. 41-42, 98-50.

Kolm et al, Electromagnetic Launchers and Guns, AD-A143778, Jun. 1980, pp. 94-95, 120-134.

Evaluation of Superconducting Augmentation on Rail Gun Systems by C. G. Homan and W. Scholz, IEEE Transactions on Magnetics, vol. Mag-20, No. 2, Mar. 1984.

IBM Scientist[illegible] ray-Painting" High Temperature Superconductors, Asbury Park Press/Sunday, May 3, 1987.

Bulk Superconductivity at 91 K in Single-Phase Oxygen-Deficient Perovskite $Ba_2YCu_3O_{9-8}$ by R. J. Cava, B. Batlogg, R. B. vanDover, D. W. Murphy, S. Sunshine, T. Siegrist, J. P. Remeika, E. A. Rietman, S. Zahurak, and G. P. Espinosa, vol. 58, No. 16, Apr. 20, 1987.

Abstracts of Physical Review B from Physical Review Abstracts, vol. 18, No. 9, May 1, 1987, p. 11.

Superconductivity Drive Gets Hotter Every Day from Electronics, Apr. 2, 1987, p. 49.

Discoveries Bring a 'Woodstock' for Physics, NY Times, Mar. 20, 1987.

Superconductivity Seen Above the Boiling Point of Nitrogen from Physics Today, Apr. 1987, p. 17.

Welch Cryorefrigerator Uses Compressed Air to Generate −140° C. Temperature, Research/Development Magazine.

Technical Data Cryodyne Closed-Cycle Helium Refrigerators, Helix Technology Corporation, 1986.

*Primary Examiner*—Stephen C. Bentley

*Attorney, Agent, or Firm*—Sheldon Kanars; John K. Mullarney

[57] ABSTRACT

A railgun with superconducting rails. The device features rails made from ceramic materials capable of becoming superconducting at relatively high temperatures. Some embodiments utilize rails made entirely from superconducting ceramics while other embodiments utilize rails with metallic cores covered by layers of superconducting ceramics. Cooling of the superconducting ceramic to a temperature below its critical temperature is accomplished by liquid nitrogen cryorefrigerator or a compressed gas cryorefrigerator.

10 Claims, 6 Drawing Sheets

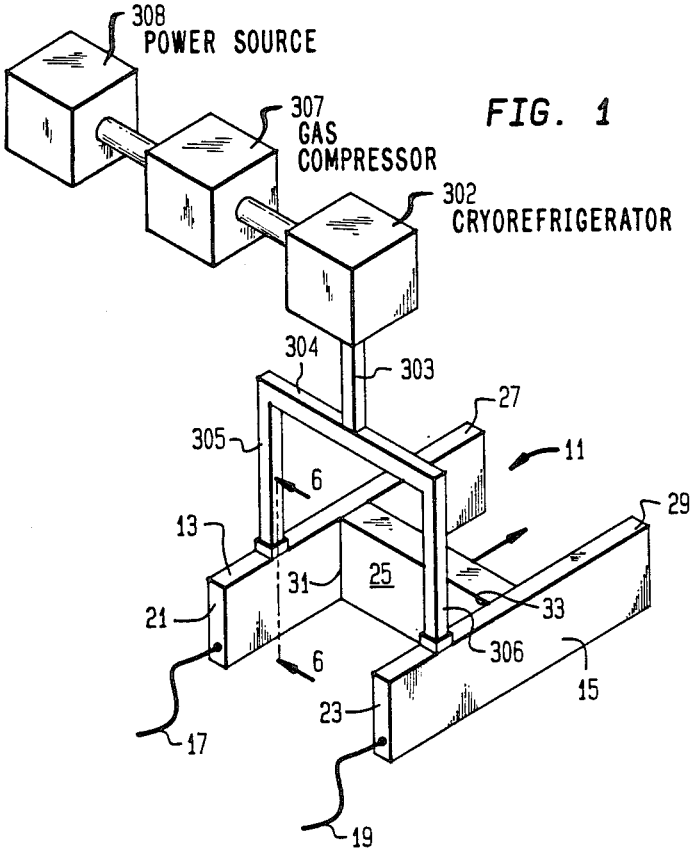
FIG. 1
FIG. 2
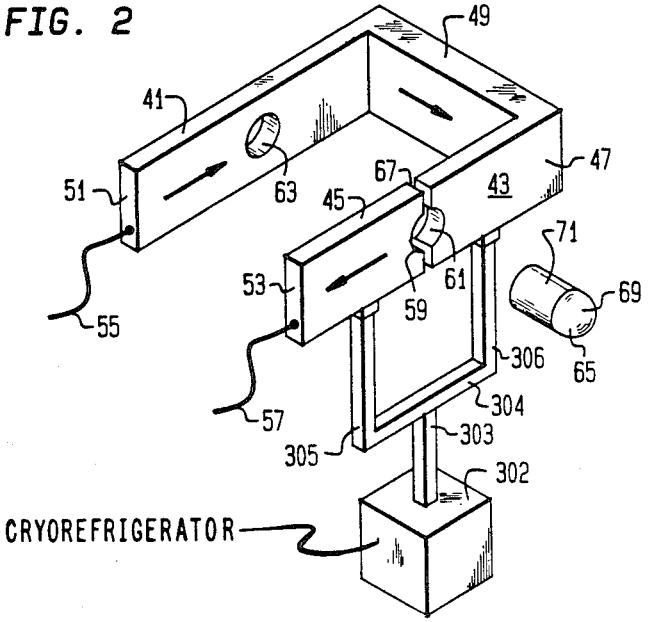

ELECTROMAGNETIC LAUNCHER WITH CRYOGENIC COOLED SUPERCONDUCTING RAILS

The invention described herein may be manufactured, used, and licensed by or for the Government for governmental purposes without the payment of any royalties thereon or therefor.

TECHNICAL FIELD

This invention relates generally to guns and projectile launchers and more particularly to devices which launch bullets or projectiles by utilizing currents in superconducting rails instead of chemical propellants.

BACKGROUND OF THE INVENTION

Conventional guns and projectile launching weapons utilize the burning of chemical propellants to achieve high projectile velocities. In recent years there has been a renewed interest in projectile launchers which utilize electromagnetic energy. Such electromagnetic launchers may find application in space launched weaponry and impact fusion as well as in more conventional ordnance. Generally speaking, electromagnetic launchers promise greater projectile velocities than launchers utilizing chemical propellants.

In electromagnetic launchers (also called railguns) large current impulses are introduced into current-carrying rail conductors to accelerate a projectile (often termed an armature).

An example of a novel railgun design together with a discussion of its operational priciples and prior art is contained in applicant's co-pending application, entitled "Electromagnetic Injector/Railgun," Ser. No. 910,915, filed Sept. 22, 1986, now abandoned. the entire disclosure of which is hereby incorporated by reference.

In general, in railgun applications, projectile velocity increases with increasing current. However, the magnitude of the current cannot be increased without limit due to joule heating of the rails, together with radiative heating of the railgun materials by plasmas, and the structural loading on the rails created by high magnetic pressures. The first-mentioned problem, joule heating, is caused by current flowing in a conductor with finite resistance. Joule heating effects are most severe when the projectile or armature is moving at high velocity and rapidly exposing new conductor material to intense currents which do not have sufficient time to diffuse into the body of the conductor. The rate of current diffusion into the body of the conductor depends upon the resistivity of the conductor. The slower the current diffusion, the larger the material resistivity. Joule heating causes rail erosion during railgun operation. This rail erosion limits the repetition rate capability and the operating life of the railgun. Joule heating in rails is not uniform because the current density is not uniform throughout the rail cross-section. Higher current densities exist near the rail surfaces and corners. Consequently, if the resistivity of the rail material could be reduced, then high peak currents, greater efficiency, high repitition rates and less rail erosion may be achieved. For example, the present inventor has developed a small-caliber electromagnetic launcher which operates at voltages below 1,000 volts. The total system resistance is 3 milliohms. The 3 milliohm resistance consists of 1 milliohm equivalent series resistance (ESR) of a capacitor bank, 1 milliohm resistance of cables and connectors, and finally, 1 milliohm resistance in the copper rails themselves. Consequently, if the resistance of the rails could be reduced to zero, then the total system resistance would be decreased by one-third. Therefore, system current would be increased by approximately the same amount, namely one-third. At present, with 3 milliohms total resistance, the peak current achieved with the already-developed device is 150,000 amperes. If the resistance of the rails could be reduced to zero, the peak current would increase to approximately 200,000 amperes. Since the velocity achieved by the projectile is approximately a linear function of rail current, a current increase of one-third, yields nearly a one-third increase in projectile velocity.

Those concerned with improving railgun performance have consistently felt a need to reduce the resistance of the rails by inducing the superconducting state. The achievement of the superconducting state has hitherto been difficult and costly because of the very low temperatures required. A discussion of the application of superconductivity to railguns is found in C. Homan et al., "Evaluation of superconducting Augmentation of Railgun Systems," IEEE Trans. on Magnetics, Vol. 20, No. 2, 03/84.

Recent developments in the field of superconductivity have produced a large variety of new ceramic-type materials which are capable of achieving the superconducting state at critical temperatures above 77° K., the boiling point of liquid nitrogen. The critical temperature is the temperature at which the material becomes superconducting. The new class of materials (termed for convenience "superconducting ceramics" herein—even for materials which are not basically ceramic in nature) have been extensively discussed in the popular press. For example, the *New York Times*, on Mar. 20, 1987 reported the existence of superconducting ceramics and described the making of such materials into sheets of vinyl-like tape and washer shapes. Furthermore, *Electronics* in its Apr. 2, 1987 issue on pp 49–51 reported the making of superconducting ceramics into wire shapes.

The composition and manufacture of superconducting ceramics is discussed, for example, in *Physics Today*, pp 17–23 April 1987 which is incorporated herein by reference. An entire class of compounds with the chemical composition R $Ba_2Cu_3O_{9-y}$, where R stands for a transition material or a rare earth ion and y is a number less than 9, preferably $2.1 \pm 0.05$ has demonstrated superconductive properties above 90° K. This class of materials is included in the terms "superconducting ceramic" and "rare-earth doped copper oxide" as used herein. Scandium, lanthanum, neodymium, samarium, europium, gadolinium, dysprosium, holmium, erbium, ytterbium, and lutetium are acceptable substitutes for R above. The crystal structure of these compounds is described as an orthorhombically distorted perovskite structure.

Some compounds are formulated substituting strontium for barium. For example, $La_{2-x}Sr_xCuO_{4-y}$ has exhibited superconductivity at high temperatures, as reported in *Physical Review Abstracts*, p. 11, vol. 18, No. 9, May 1, 1987.

Fabrication of superconducting ceramics is discussed in *Physics Today* article. A detailed discussion the above-mentioned of the fabrication and physical properties of a typical superconducting ceramic is also found in: R. J. Cava et al., "Bulk Superconductivity at 91° K. in Single Phase Oxygen—Deficient Perovskite $Ba_2YCu_3O_{9-\delta}$, *Physical Review Letters*, pp 1676–1679, 20 Apr. vol. 58, number 16.

Another important technological development is the advent of small, relatively portable cryorefrigerators. Some small cryorefrigerators employ liquid nitrogen (with a boiling point of 77° K.) and others, such as the Welch cryorefrigerator use compressed air to generate temperatures as low as 98° K. (−175° C.). The Welch cryorefrigerator is a compact mechanical refrigerator which utilizes compressed air to achieve low temperatures.

Another small cryorefrigerator is the Cryodyne® closed cycle helium refrigerator manufactured by CTI Cryogenics. The Cryodine® cryorefrigerators are capable of cooling to temperatures of 77° K. (in some applications, according to the manufacturer, Cryodine® units are used to cool scientific equipment to 6° K.). The cryorefrigerators utilize helium supplied through a compressor.

Despite these advances there remains a continuing need for simple railguns with low electrical resistance.

SUMMARY OF THE INVENTION

It is an object of the present invention to provide a electromagnetic projectile launcher with reduced resistance.

It is another object of the present invention to provide a projectile launcher capable of achieving ultra high projectile velocities.

A further object of the present invention is to provide an electromagnetic projectile launcher with minimal joule heating losses.

The present invention utilizes a new class of superconducting materials. These new materials are capable of achieving the superconducting state (and thus providing zero resistance to the flow of electric current) at temperatures much higher than those hitherto possible.

The composition and properties of those materials have already been discussed. The materials can be made in sheet form or fabricated as solid bodies. Plasma spraying techniques can be utilized. In the text that follows, these materials will be generally termed superconducting ceramics. Such materials can be made superconducting by liquid nitrogen refrigeration, or commercially available cryorefrigerators which utilize compressed air or helium. A compressed air cryorefrigerator costs and weighs less than a conventional liquid nitrogen cryorefrigerator at the sacrifice of lower pumping capacity.

The present invention features a variety of railgun configurations. In some instances, the rails themselves are made from superconducting materials. In other cases, the rails are made from conventional conducting materials such as copper or copper tungsten alloy which is covered with a layer of superconducting material.

The inventive principles of the present invention are applicable to pod-mounted weapons as well as larger-bore stationary artillery and even to space-based anti-missile defenses.

BRIEF DESCRIPTION OF THE DRAWINGS

Further objects and advantages of the present invention will become apparent to those familiar with the art upon examination of the following detailed description and accompanying drawings in which:

FIG. 1 is a schematic perspective view of a preferred embodiment of the present invention;

FIG. 2 is a schematic perspective view of another embodiment of the present invention;

DETAILED DESCRIPTION OF THE PREFERRED EMBODIMENTS

Figure 3:
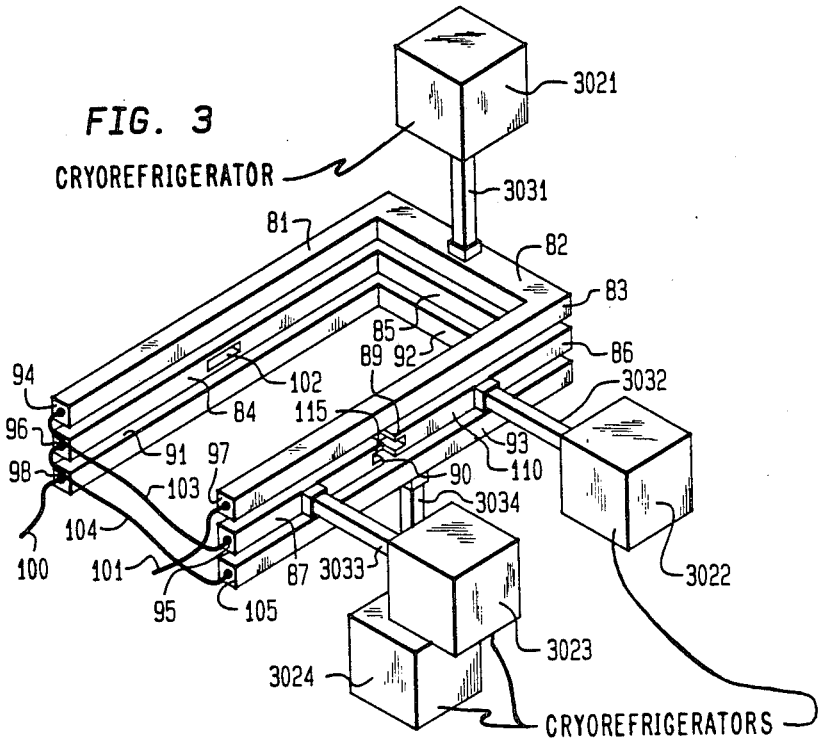
FIG. 3 is a schematic perspective view of another embodiment of the present invention.

Referring to the drawings, wherein like numerals refer to like components throughout, and particularly to FIG. 1, reference numeral 11 designates generally an inventive device. Two anchored parallel conductive rails are denoted respectively by reference numerals 13 and 15. Ends 21 and 23 of rails 13 and 15 respectively are connected via lead 17 and 19 to a voltage source (not shown).

Armature 25 fits closely between rails 13 and 15. Application of a high voltage between leads 17 and 19 causes current to flow (depending upon polarity) into end 23 of rail 15, thence through armature 25, and out through end 21 and lead 17. Reversal of the voltage polarity causes current to flow in the other direction, i.e., into lead 17 and out from lead 19. In any event, the aforementioned current creates a magnetic field between the rails perpendicular to the plane of the rails 13 and 15. The Lorentz force created by interaction between the current flowing through armature 25 and the magnetic field acts upon armature 25 and rapidly accelerates armature 25 towards ends 27 and 29 of rails 13 and 15 respectively. Armature 25 may be an integral part of a bullet-like projectile or armature 25 may simply serve to provide acceleration for a separate detachable bullet-like projectile.

Rails 13 and 15 may be made entirely from the superconducting ceramic materials previously described. Alternatively, a layer of superconducting ceramic may be deposited upon a metallic rail, the metal serving to provide structural strength. Non metallic, high strength materials may also be used to provide strength. In the latter case, the thickness of the superconducting ceramic should be at least equal to the skin depth of the current flowing through the rails.

Of course, to maintain superconductivity, it is necessary to cool rails 13 and 15. Cryorefrigerator 302 may be a Cryodine or similar type which operates upon compressed gas and can achieve temperatures at least as low as the critical temperature of the superconducting material (about 90° K.). Cryorefrigerator 302 has a shaft 303. Shaft 303 is chilled by cryorefrigerator 302. In FIG. 1, shaft 303 is connected to adaptor 304. Adaptor 304 has two arms, 305 and 306. Adaptor 304 is made from copper or any other material with good thermal conductive properties. Arms 305 and 306 are attached to rails 13 and 15 respectively. Details of the method of attachment will be explained subsequently. Gas compressor 307 operated by power source 308 serves to energize cryorefrigerator 302.

If desired, adaptor 304 may be eliminated and two (or more) cryorefrigerators may be employed, at least one for each rail. Furthermore, should the cryorefrigerator be unavailable or incapable of sustaining the low temperatures needed to maintain superconductivity in the rails, a liquid nitrogen portable cryogenic refrigerator well known to those skilled in the art may be utilized. If a liquid nitrogen portable cryogenic refrigerator is used, air compressor 307 and power source 308 may be eliminated. However, it will be necessary to provide a continuous source of liquid nitrogen to compensate for evaporation.

Figure 6:
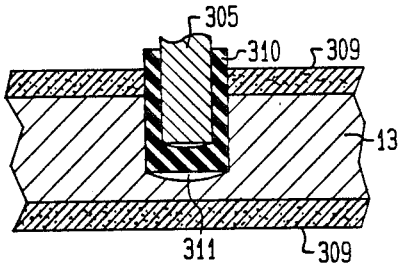
FIG. 6 is partial cross-sectional view of the device of FIG. 1 cut along the line 6—6 and looking in the direction of the arrows.

The method by which arm 305 or 306 may be attached to a rail, such as rail 13 or 15, is illustrated in FIG. 6. FIG. 6 illustrates a metallic rail 13 with a top layer of superconducting ceramic 309. As mentioned before, rail 13 may be fabricated from copper or copper tungsten alloy metallic core with a superconducting ceramic layer of at least skin depth thickness secured to the outside surfaces. It is also possible to make rail 13 entirely from superconducting ceramic material. For convenience, the first alternative is illustrated in FIG. 6. Arm 305, being made from metal, is shown surrounded by cap 310. Cap 310 is made from materials with high thermal conductivity and low electrical conductivity, such as boron nitride or beryllium oxide. The purpose of cap 310 is to prevent electrical contact between the end of metallic arm 305 and either superconducting ceramic 309 or the metallic portion of rail 13. Should electrical contact occur, the high currents flowing through rail 13 and/or superconducting ceramic 309 will ultimately enter cryorefrigerator 302 with adverse effect. However, it is necessary to provide good thermal contact between arm 305 metal rails and superconducting ceramic 309. Cap 310 being made from materials with good thermal conductive properties, permits chilling of superconducting ceramic 309 to or below its critical temperature (i.e., the temperature at which material 309 become superconducting). However, cap 310 also serves to electrically isolate arm 305 (and therefore cryorefrigerator 302) from the high currents which flow in superconducting ceramic 309. Arm 305 may be press-fit into cap 310 which, in turn, may be press fit into hole 311 in rail 13.

Figure 7:
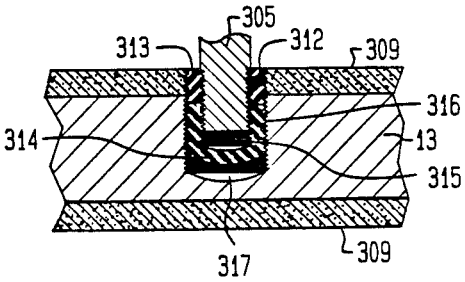
FIG. 7 is an alternative partial cross-sectional view which may be substituted for the view of FIG. 6.

An alternative method of securing arm 305 to rail 13 is illustrated in FIG. 7. Arm 305 is fitted with threaded stud 312. A threaded sleeve 313 made from boron nitride, beryllium oxide or another material which has good thermal conductive properties and poor electrical conductive properties is threaded upon stud 312. Cap 314 fits upon the end of stud 312. Cap 314 has a threaded interior hole 315 which mates the threads of stud 312. Cap 314 also has external threads 316 which fit within threaded hole 317 in rail 13. Thus, the combination of sleeve 313 and cap 314 serve to prevent electrical contact between arm 305 and either superconducting ceramic 309 or metal rail 13. However, both sleeve 313 and cap 314 being made of materials with good thermal conducting properties permit the chilling of superconductive ceramic 309 to or below its critical temperature. If desired, sleeve 313 and cap 314 may be made integral.

A variety of other effective means for achieving good heat exchange between superconducting ceramic 309 and a cryorefrigerator are known to those skilled in the art.

Another embodiment of the present invention is illustrated in FIG. 2. The device shown in FIG. 2 features two long, electrically conductive rails 41 and 43. The rails are joined by a comparatively short conductive section 49. The length of rails 41 and 43 is considerably longer than the length of section 49. Section 49 need not physically resemble rails 41 and 43 at all. The only purpose of section 49 is to conduct current from rail 41 to rail 43 (or vice versa), and so, section 49 may be conductive wire or cable. The entire assembly, consisting of rails 41 and 43 and section 49 is immovably anchored on a platform (not shown). Furthermore, as discussed in connection with FIG. 1, the entire assembly, consisting of rails 41 and 43 and section 49 may be made entirely of superconducting ceramic or may consist of a metallic substrate covered with a layer of superconducting ceramic. A gap 67 separates halves 45 and 47 of rail 43. The contoured sides defining gap 67 may also be coated or covered with superconducting ceramic. Rails 45 and 47 have semi-circular notches 59 and 61 respectively adjacent gap 67. A generally cylindrical projectile 65 is dimensioned so that it will fit closely within the hole defined by semi-circular notches 59 and 61 and thereby provide continuous electrical contact between rail halves 45 and 47 of rail 43.

A DC voltage source (not showm) is connected via leads 55 and 57 to ends 51 and 53 respectively of rails 41 and 45. The presence of gap 67 prevents current from flowing through rails 41, 49 and 43. However, should a metallic conducting projectile 65 be introduced into gap 67 so that projectile 65 fits closely within the hole defined by semi-circular notches 59 and 61, current will flow through rail 43. The projectile 65, being unrestrained, will be launched outward, perpendicular to rails 41 and 43.

Rails 41, 49 and 43 are maintained in a superconducting state by the use of cryorefrigerators similar to those illustrated in FIG. 1. In FIG. 2, cooling of the rail region surrounding gap 67 is accomplished by cryorefrigerator 302. (Necessary gas compressors and power supplies are omitted for simplicity). Shaft 303 extending from cryorefrigerator 302 is connected to adaptor 304. Adaptor 304 has two arms 305 and 306 which are positioned on opposite sides of gap 67. Arms 305 and 306 may be secured to rail halves 45 and 47 by techniques already illustrated and discussed in connection with FIGS. 6 and 7. A variety of cryorefrigerators 302 may be positioned at various locations along rails 41, 49 and 43 to ensure that the entire railgun structure is in the superconducting state. If desired, adaptor 304 may be eliminated and individual cryorefrigerators 302 directly attached to various portions of the aforementioned rails 41, 49 and 43 by shafts in a manner analogous to that illustrated in FIGS. 6 and 7.

Hole 63 in rail 41 permits introduction of projectile 65 from the left. There is no gap in rail 41; consequently, current may flow unimpeded through rail 41 despite the presence of the hole 63. The diameter of the hole 63 must be larger than the diameter of the projectile 65. Hole 63 is directly oppositely the hole defined by semi-circular notches 59 and 61. The projectile may be introduced from the left through hole 63 by mechanical or pneumatic means. For example, a pneumatic tube may be used to shoot projectile from the left through hole 63. The projectile then traverses the space between rails 41 and 43, ultimately coming to the hole defined by notches 59 and 61. When projectile 65 contacts the hole defined by notches 59 and 61, projectile 65 functions like a closed switch, permitting a sudden large current to flow through rails 41, 49 and 43. The resulting repulsive force between rails 41 and 43 provides an acceleration to projectile 65, causing projectile 65 to be hurled to the right.

In a preferred embodiment of the present invention, rails 41 and 43 are 0.58 meters long and the spacing between the rails (i.e., the length of rail 49) is 0.01 meters (0.375 inches). The configuration shown schematically in FIG. 2 is suitable for application of relatively low DC voltages for example, a voltage less than 1,000 volts, to leads 55 and 57. The voltages may be provided by a capacitor bank charged by batteries or any other suitable means. In a preferred embodiment, the capacitor bank is charged to 500 volts producing a peak current of 150 kiloamperes.

Projectile 65 may have a curved phenolic header section 69 and a cylindrical metallic section 71 made from 65 copper disks of 0.2265 inches diameter. The purpose of the optional phenolic header 69 is to improve aerodynamic performance and to allow the projectile to be seated in the hole defined in rail 43 before the metallic section 71 makes contact with the sides of the notches 59 and 61. The total weight of projectile 65 in the embodiment presented above is 2 to 3 grams.

It is also possible in the configuration depicted in FIG. 2 to cool only certain portions of rails 41, 49 and 43. For example, the solid portion of rails 41, 49 and 43 may be cooled while the areas immediately adjacent hole 61 in gap 67 may be left at room temperature. Alternatively, the area immediately adjacent hole 61 in gap 67 may be cooled, while other regions of rails 41, 49 and 43 are left at room temperature. This selective cooling approach still reduces the overall resistance of the railgun system, although, of course, preventing superconductivity throughout the entire device.

Another embodiment of the present inventive device is illustrated in FIG. 3. The device of FIG. 3 has three sets of parallel rails electrically interconnected to constitute one coil with three turns. A projectile is ejected from the side of the center pair of rails. In particular, reference numerals 81 and 83 designate two long parallel upper rails, connected by short rail 82. Spaced directly beneath the aforementioned set of rails, 81, 82 and 83, is a second set of rails 84, 85 and 110. Rails 84 and 110 are long parallel rails positioned directly beneath their counterparts, rails 81 an 83. Long rails 84 and 110 are connected by short rail 85. There is a hole 102 in rail 84. Hole 102 facilitates the introduction of a projectile (not shown) from the left of the drawing. Rail 110 is split at gap 90 into two halves 86 and 87. Each half of rail 110 contains a notch 89 and 115. The notches 89 and 115 are illustrated as rectangular, while notches 59 and 61 of FIG. 2 were illustrated as circular. The shape of the notch is immaterial as long as the notch fits the projectile close enough to make good electrical contact. End 94 of rail 81 is connected to end 95 of rail 87 by connecting lead 103. Spaced directly beneath the aforementioned two sets of rails is a third set. Rail 91 is directly beneath rails 84 and 81; rail 92 is directly beneath rails 85 and 82. Rail 93 is directly beneath rails 110 and 83. Rails 91, 92 and 93 are electrically connected together. The end 96 of rail 84 is electrically connected to the end 105 of rail 93 by connecting lead 104.

End 98 of rail 91 is connected via a lead 100 to a DC voltage source (not shown). Similarly, end 97 of rail 83 is connected to the opposite polarity of the same DC voltage source by lead 101. In operation, the projectile in pneumatically or mechanically injected from the left through hole 102. If the metallic portion of the projectile contacts the sides of notches 115 and 89, it serves as a switch, closing the DC circuit and permitting current to flow to the coil. The projectile is ejected at high speed to the right of FIG. 3.

In the embodiments of both FIG. 2 and FIG. 3, the current flows through the circuit when the switch is closed (i.e., when the metallic portion of the projectile contacts the respective sides of the notches) and the magnetic field is created by the current itself.

As already discussed in connection with FIGS. 1 and 2, all of the rails illustrated in FIG. 3 (i.e., rails designated by reference numerals 81, 82, 83, 84, 85, 110, 91, 92, and 93) may be fabricated from superconducting ceramic. Alternatively, each of the aforementioned rails may be fabricated from a metal and coated with superconducting ceramic to the appropriate skin depth. Of course, as already mentioned, it is necessary to maintain all or portions of the superconducting ceramic below its critical temperature. Consequently, several cryorefrigerators (3021, 3022, 3023, and 3024) are depicted.

Cryorefrigerator 3021 is connected via shaft 3031 to rail 82. FIGS. 6 and 7, already discussed, illustrate typical connection methods. Should cryorefrigerator 3021 be insufficient to cool the top set of rails, namely rails 81, 82 and 83, additional cryorefrigerators may be mounted, using the techniques of FIGS. 6 and 7, on the upper set of rails.

Cryorefrigerator 3022 is connected via shaft 3032 to rail 110. Additional cryorefrigerators may be connected to rails 84 and 85, if desired. Of course, cryorefrigerator 3022 is incapable of cooling rail half 87. Consequently, an additional cryorefrigerator 3023 is attached via shaft 3033 to rail half 87. Finally, the lower triplet of rails, 91, 92 and 93 is cooled by cryorefrigerator 3024 via shaft 3034.

A greater or lesser number of cryorefrigerators may be added to the embodiment illustrated in FIG. 3 depending upon the amount of resistance reduction required. Details such as power supplies and compressed gas supplies for the cryorefrigerators have been omitted from FIG. 3.

Figure 4:
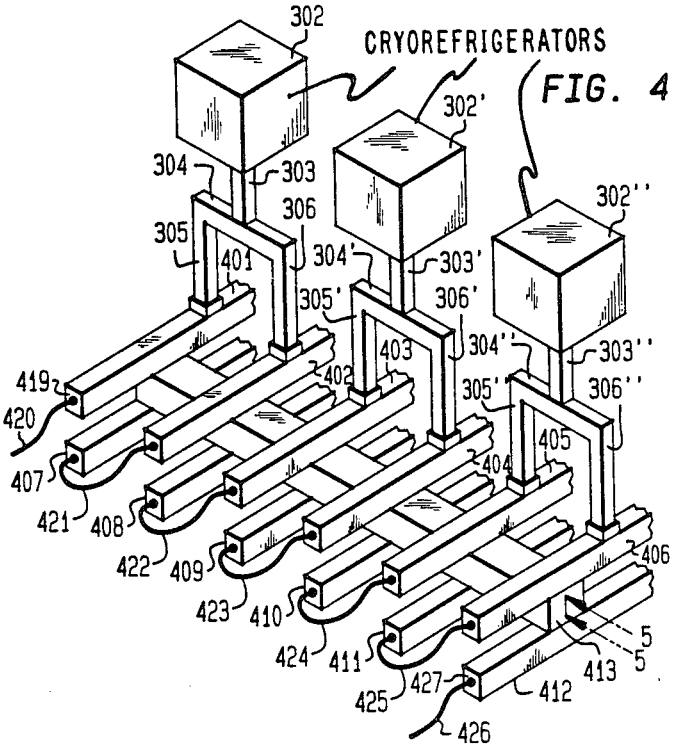
FIG. 4 is a schematic perspective view of another embodiment of the present invention.
Figure 5:
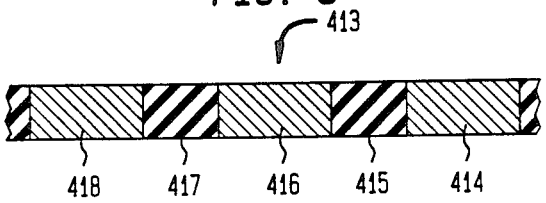
FIG. 5 is a cross-sectional view of the armature in FIG. 4 cut along the line 5—5 and looking in the direction of the arrows.

FIGS. 4 and 5 illustrate another embodiment of the inventive device. FIG. 4 depicts an augmented railgun consisting of more than one set of parallel rails and a segmented (metal-insulator) armature. Shown in FIG. 4 are six parallel upper rails 401–406. Immediately beneath and parallel to each of the upper rails is a lower rail designated respectively by reference numerals 407–412. Each of the rails 401–412 may be made from superconducting ceramic material or, as already discussed, may be made from metal or a high strength material covered with superconducting ceramic. Sandwiched between the two sets of upper and lower rails is a segmented armature 413 which serves as a projectile to be ejected toward a chosen target. Armature 413 is made of alternating metallic and insulating sections as illustrated in FIG. 5. The metallic sections of armature 413 are positioned between upper and lower rails, while the insulating sections of armature 413 serve to prevent transferred current flow. For example, metallic section 414 of armature 413 may be positioned between rail 406 and 412, while metallic section 416 of armature 413 may be positioned between rails 405 and 411 and metallic section 418 of armature 413 may be positioned between rail 404 and 410, etc. Since rails 405 and 406 are spaced apart, insulator 415 of armature 413 does not substantially contact any rail. Only three metallic segments of armature 413 have been illustrated for convenience in FIG. 5. However, as is apparent from an examination of FIG. 4, a six-metallic segment armature would be appropriate for the six-rail pair device of FIG. 4.

The rails of FIG. 4 are connected so that the end of any particular bottom rail is connected to the end of the rail to the above right. For example, the end of rail 407 is connected via conductor 421 to the end of rail 402; the end of rail 408 is connected via conductor 422 to the end of rail 403; the end of rail 409 is connected via conductor 423 to the end of rail 404, etc. The end 419 of rail 401 and the end 427 of rail 412 are connected via conductors 420 and 426 to a DC voltage source (not shown). Application of the large DC voltage to conductors 420 and 426 causes armature 413 to be propelled rapidly in a direction away from the connected ends of the rails.

The railgun device of FIG. 4 may be made superconducting by the cryorefrigeration techniques already described. Specifically, cryorefrigerators 302, 302′ and 302″ are positioned to lower the temperature of rails 401–406 to a temperature beneath the critical temperature of the superconducting ceramic. Cryorefrigerators which may be utilized to cool the lower set of rails 407–412 have been omitted in the interest of clarity. Cryorefrigerator 302 is connected via shaft 303 to fixture 304. Arms 305 and 306 extend from fixture 304. Arm 305 is connected to rail 401 utilizing techniques already disclosed and discussed in connection with FIGS. 6 and 7. Similarly, arm 306 is connected to rail 402. One cryorefrigerator, namely that designated by reference numeral 302 is utilized to cool two rails, namely rails 401 and 402. If desired, a single cryorefrigerator may be used for each rail or it may even be desirable to use a multiplicity of cryorefrigerators for each rail. Cryorefrigerators 302′ and 302″ serve to cool rails 403–406 in a manner already exhaustively described. Details of the power supply and compressed gas supply for each of the cryorefrigerators 302–302″ have been omitted in the interest of clarity.

Figure 8:
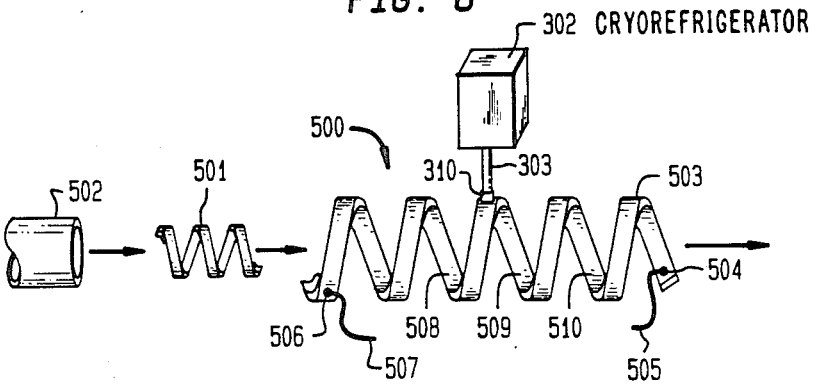
FIG. 8 is a perspective view of another embodiment of the present invention.
Figure 12:
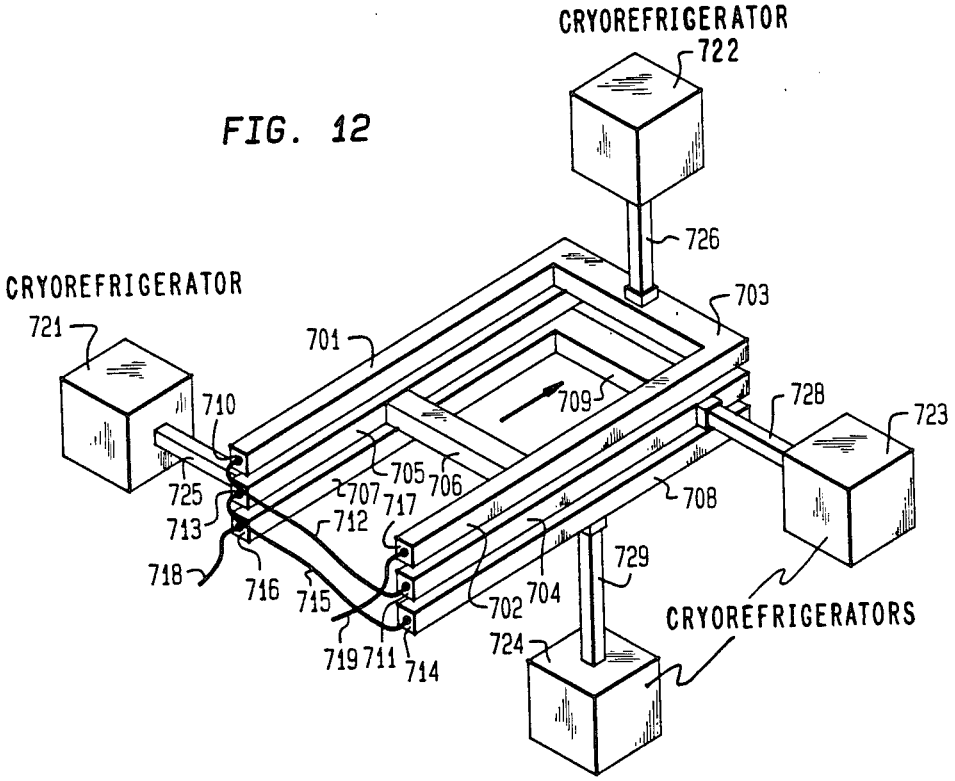
FIG. 12 is a schematic perspective view of another embodiment of the present invention.

Another embodiment of the present device is illustrated in FIG. 12. In FIG. 12 reference numerals 701 and 702 designate a pair of long parallel rails. Rail 703 connects rails 701 and 702. Rails 705 and 704 are positioned respectively beneath rails 701 and 702. Armature 706 is positioned between and contacts rails 705 and 704. Rail 707 is positioned beneath rails 701 and 705. Rail 708 is positioned beneath rails 702 and 704. Rail 709 connects rails 707 and 708 in a manner similar to that provided by rail 703 for rails 701 and 702. Thus, what has been described is three pairs of parallel rails, the top and bottom pairs being connected by shorter rails. End 710 of rail 701 is connected to end 711 of rail 704 by conductor 712. Similarly, end 713 of rail 705 is connected to end 714 of rail 708 by conductor 715. Finally, ends 716 of rail 707 and end 717 of rail 702 are connected via conductors 718 and 719 to a voltage source (not shown). Application of a voltage to conductors 718 and 719 will cause armature 706 to be accelerated between rails 705 and 704 through the space between rails 703 and 709 toward a chosen target. The device of FIG. 12 resembles the device of FIG. 1 with interconnected rails both above and below which serve to increase system inductance. Cryorefrigerators 721, 722, 723, and 724 are connected via shafts 725, 726, 728, and 729 respectively to various positions of the rails just described. Each of the aforementioned rails, namely rails 701, 702, 703, 705, 704, 707, 708, and 709 are covered with a layer of the aforedescribed superconducting ceramic. Connection of the cryorefrigerators 721, 722, 723, and 724 may be made via the techniques previously described in the other embodiments or by any other method which affords close physical contact between the ends of shafts 725, 726, 728, or 729 and the layer of superconducting ceramic. Of course, additional cryorefrigerators may be employed to ensure that the entire rail assembly depicted in FIG. 12 is at a temperature below the critical temperature of the superconducting ceramic. Another embodiment of the present invention is illustrated in FIG. 8. Shown therein is an induction accelerator 500. The accelerator is a coil 503 made from superconducting ceramic material. Alternatively, coil 503 may be made from metal with a layer of superconducting ceramic on the top surface. Individual coil turns 508, 509 and 510 do not touch one another. Terminal 504 at one end of coil 503 is connected to lead 505. Terminal 506 at the opposite end of coil 503 is connected to lead 507. Leads 505 and 507 are connected to a DC voltage source (not shown). The projectile for the weapon of FIG. 8 is a second, smaller coil 501. Coil 501 is wound in a direction opposite to the winding of coil 503. Furthermore, coil 501 fits within coil 503. Coil 501 is sized so that it will pass completely through the interior of coil 503 without contact between the two coils (but as close as possible to increase coupling). In operation, coil 501 is ejected by mechanical or pneumatic means 502 into coil 503. The DC voltage applied to coil 503 via leads 505 and 507 produces a traveling field which accelerates coil 501 through coil 503.

Accelerator 500 is maintained below the critical temperature for superconductivity by cryorefrigerator 302. Shaft 303 extends from cryorefrigerator 302 and penetrates coil 503 in a manner similar to that illustrated in FIGS. 6 or 7. Cap 310, being made from boron nitride, or beryllium oxide for example, prevents electrical contact between cryorefrigerator 302 and coil 503, while permitting cooling of coil 503. Of course, as mentioned before, several cryorefrigerators 302 may be positioned at strategic locations along coil 503 to maintain the entire coil or only parts thereof in the superconducting state.

Figure 9:
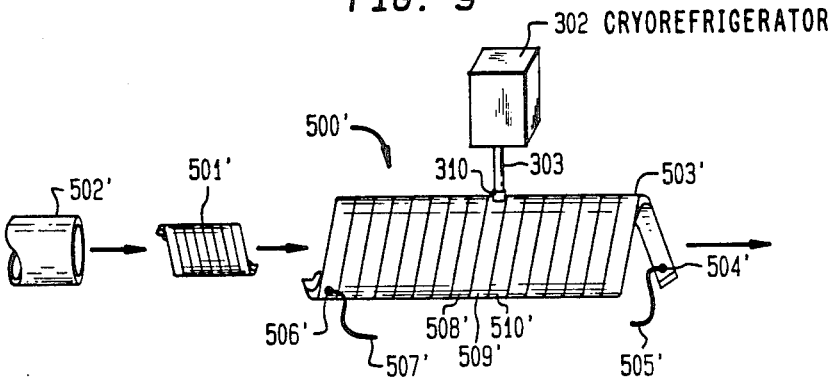
FIG. 9 is a perspective view of another embodiment of the present invention.

Another embodiment of the present invention is illustrated in FIG. 9. FIG. 9 also illustrates an induction accelerator. However, individual coils of induction accelerator 500′ touch one another instead of being separated as illustrated in FIG. 8. For example, coils 508′, 509′ and 510′ of FIG. 9 physically contact one another, whereas their counterparts in FIG. 8 are separate. Essentially, the coil depicted in FIG. 9 has a greater inductance, and is therefore, a better accelerator than the coil depicted in FIG. 8. As has already been described, terminal 504′ is connected to lead 505′ and terminal 506′ is connected to 507′. Leads 505′ and 507′ are connected to a DC voltage source (not shown). Coil 501′, which serves as the armature or projectile, is likewise smaller than coil 503′ and capable of sliding freely through the interior of coil 503′ without touching. Coil 501′ is ejected into coil 503′ by pneumatic or mechanical means 502′.

Figure 10:
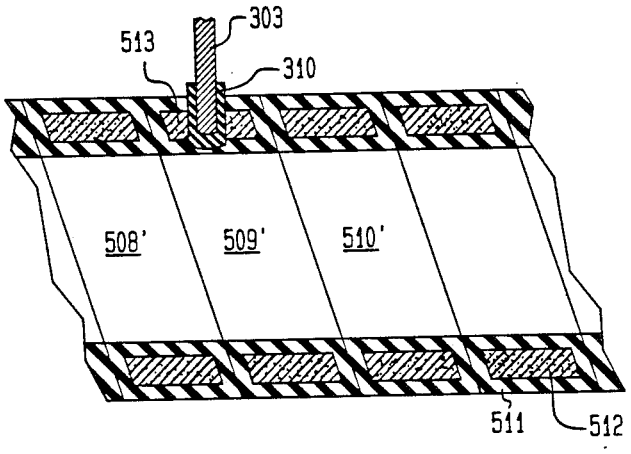
FIG. 10 is a cross-sectioned view of the device of FIG. 9 cut along the line (10—10 and looking in the direction of the arrows.

Since the individual coils 508', 509' and 510' of FIG. 9 touch one another, it is necessary to electrically insulate them, one from another, so that coil 503' does not short out. FIG. 10 is a cross-sectional view illustrating the construction of coil 503', and in particular individual coils 508', 509' and 510'. It can be seen that each individual coil has a core 512 of superconducting ceramic surrounded by insulating material 511. Boron nitride or beryllium oxide are a good candidate for insulator 511. Consequently, there is good thermal contact between individual coils 508', 509', and 510', while electrical isolation is preserved. Connection of cryorefrigerator 302 via shaft 303 to coil 509' is also illustrated in FIG. 10. Cap 310, being made from boron nitride fits on the end of shaft 303. Cap 310 penetrates superconducting ceramic 513 without completely severing it. Thus, metal shaft 303 is capable of chilling superconducting ceramic 513 without electrical contact. As mentioned before, although only one cryorefrigerator 302 is illustrated in FIGS. 8 and 9, a plurality of such cryorefrigerators may be employed to maintain the entire accelerating coil below its critical temperature.

For simplicity, the embodiments of FIGS. 8–10 have eliminated discussion of the power supply and gas or liquid nitrogen supply required for cryorefrigerator 302.

In all of the foregoing embodiments there will be strong magnetic forces which will tend to urge parallel conductors apart. Consequently, each of the foregoing embodiments requires one or more means for anchoring the parallel rails so that they do not fly apart. In the embodiments of FIGS. 1–4, the outside rail surfaces may be covered with an insulator and rails enclosed in a metal can or girdled together by metal bands.

Similarly, the embodiment of FIG. 8 may have insulating material inserted on the outer surfaes of individual coils and the entire coil encased in a container made from metal or other high strength material. The embodiment of FIG. 9, which already has an insulator on the outer surface of its coils may be simply enclosed in a container of metal or other high strength material.

Figure 11:
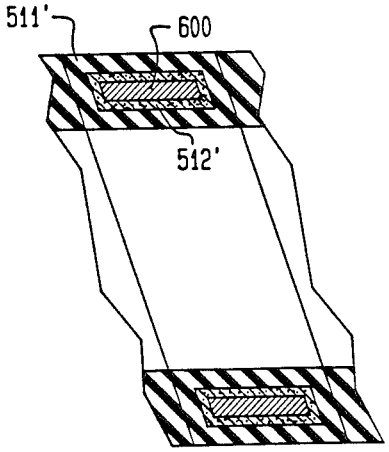
FIG. 11 is an alternative partial cross-sectional view of the device of FIG. 9.

FIG. 11 depicts an alternative construction suitable for the embodiments of both FIGS. 9 and 8. In FIG. 11 the superconducting ceramic 512' surrounds a metal core 600. Both ceramic 512' and metal core 600 are encapsulated in an insulator 511'. As long as the temperature of ceramic 512' is maintained at or below its critical temperature, the ceramic will be superconducting and resistance of the coil will be zero. Should the refrigeration system fail and the temperature of the ceramic somehow rise above the critical temperature, conduction will take place through the copper.

In all of the previously discussed embodiments, whatever cryofrigerators are required to cool the rails or coils, may be powered by a single large power supply and provided with compressed gas or liquid nitrogen via a single source and manifold instead of utilizing individual power supplies and individual gas or liquid nitrogen sources as shown in FIG. 1.

In all of the previously discussed embodiments, condensation on the rail surfaces may be a problem. The problem may be overcome by surrounding as much of the rail structure as is feasible with a vacuum envelope. For example, in FIGS. 8 and 9 coils 500 and 500' may be surrounded inside and out with a vacuum envelope. (The vacuum envelope will not affect passage of small coils 501 or 501' through larger coils 500 or 500' because the small coils do not physically touch the larger coils during transit). Similarly, in FIG. 3 rails 81, 82, 83, 91, 92, and 93 may be enclosed in a vacuum envelope with only leads to 103 and 104 protruding and rails 84, 85, 87, and 110 unenclosed. Thus the upper and lower sets of rails may be enclosed in a vacuum envelope while the central set is unenclosed to permit projectile ingress and egress through hole 102 and gap 90.

In FIG. 12, the upper and lower rail sets, namely rails 701, 702, 703 and 707, 708 and 709 may be enclosed in a vacuum envelope with only leads 712 and 715 protruding.

The illustrative embodiments herein are merely a few of those possible variations which will occur to those skilled in the art while using the inventive principles contained herein. Accordingly, numerous variations of invention are possible while staying within the spirit and scope of the invention as defined in the following claims and their legal equivalents.

What is claimed is:

1. A device for accelerating a projectile comprising:

first and second parallel rails each of said rails having a respective hole, said rails being made from metal at least partially covered with material which is capable of superconductivity above 77° K.;

means for applying a voltage to said rails;

a cryorefrigerator having a chilled shaft extending therefrom;

an adapter attached to said shaft, said adapter having first and second arms, said first arm extending into said hole of said first rail and said second arm extending into said hole of said second rail, so that said material becomes superconducting and application of said voltage causes acceleration of said projectile.

2. A device as defined in claim 1 wherein said material comprises a rare-earth doped copper oxide.

3. A device as defined in claim 1 wherein said material comprises a ceramic having a critical temperature for superconductivity above 77° K.

4. A device as defined in claim 1 wherein said material has the chemical formula of $RBa_2Cu_3O_{9-y}$, where R is selected from the group consisting of scandium, europium, gadolinium, dysprosium, holmium, erbium, ytterbium, and lutetium, and y is a number less than 9.

5. The device of claim 4 wherein y is $2.1 \pm 0.05$.

6. A device as defined in claim 1 wherein caps of boron nitride are positioned on the ends of said arms to provide electrical insulation from said rails and material.

7. A device as defined in claim 1 wherein caps of beryllium oxide are positioned on the ends of said arms to provide electrical insulation from said rails and material.

8. A electromagnetic railgun for accelerating a projectile comprising a pair of coextensive parallel conductive rails spaced a predetermined distance apart, each of said rails being covered with a superconductive material of predetermined thickness, one or more holes in each of said rails, cryorefrigerator means serving to generate temperatures at or below the superconductivity temperature of said material, one or more thermally conductive arms or shafts extending from said cryorefrigerator means into said one or more holes, each arm having a cap or sleeve on the end thereof that extends into a hole, each cap being thermally conductive and electrically insulating, and means for applying a voltage to said pair of rails so as to cause acceleration of said projectile.

9. A railgun as defined in claim 8 wherein said superconductive material is capable of superconductivity above 77° K.

10. A railgun as define in claim 9 wherein said superconductive material is comprised of a selected ceramic.

* * * * *